US011800910B2

(12) United States Patent
Cobb

(10) Patent No.: US 11,800,910 B2
(45) Date of Patent: Oct. 31, 2023

(54) ARTICLE OF FOOTWEAR WITH LACING SYSTEM

(71) Applicant: Wolverine Outdoors, Inc., Rockford, MI (US)

(72) Inventor: Ian M. Cobb, Rockford, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 123 days.

(21) Appl. No.: 17/403,229

(22) Filed: Aug. 16, 2021

(65) Prior Publication Data

US 2021/0368944 A1 Dec. 2, 2021

Related U.S. Application Data

(63) Continuation of application No. 16/518,044, filed on Jul. 22, 2019, now Pat. No. 11,206,898.

(51) Int. Cl.

| | |
|---|---|
| ***A43C 1/00*** | (2006.01) |
| ***A43C 1/04*** | (2006.01) |
| ***A43B 1/04*** | (2022.01) |
| ***A43B 23/02*** | (2006.01) |

(52) U.S. Cl.

CPC ..... *A43C 1/04* (2013.01); *A43B 1/04* (2013.01); *A43B 23/027* (2013.01); *A43C 1/00* (2013.01)

(58) Field of Classification Search

CPC ..... A43B 1/04; A43B 23/0265; A43B 23/027; A43C 1/00; A43C 1/003; A43C 1/04; A43C 11/008

See application file for complete search history.

(56) References Cited

U.S. PATENT DOCUMENTS

| | | | | | |
|---|---|---|---|---|---|
| 712,003 | A * | 10/1902 | Payne | A43C 1/04 | 24/714.7 |
| 2,369,254 | A * | 2/1945 | Roman | A43C 1/04 | 36/50.1 |
| 2,406,528 | A | 8/1946 | Blair | | |
| 5,463,822 | A * | 11/1995 | Miller | A43C 11/165 | 36/50.1 |
| 6,128,835 | A * | 10/2000 | Ritter | A43C 1/00 | 36/114 |
| D447,860 | S | 9/2001 | Matis et al. | | |
| D612,144 | S | 3/2010 | Bosomworth | | |
| 7,870,682 | B2 | 1/2011 | Meschter et al. | | |
| 8,266,749 | B2 | 9/2012 | Dua et al. | | |
| 8,266,827 | B2 | 9/2012 | Dojan et al. | | |
| 8,453,357 | B2 * | 6/2013 | Beers | A43C 1/00 | 36/137 |
| D711,643 | S | 8/2014 | Bosomworth | | |
| 8,887,410 | B2 | 11/2014 | Dojan et al. | | |

(Continued)

OTHER PUBLICATIONS

Merrell Footwear Fall 2001 Catalog, pp. 12, 14.

(Continued)

*Primary Examiner* — Sharon M Prange

(74) *Attorney, Agent, or Firm* — Warner Norcross + Judd LLP

(57) ABSTRACT

An article of footwear including a sole, an upper joined with the sole, and a lacing system. The lacing system is configured to secure the footwear to the wearer's foot and includes a lace support embroidered to the upper. The lace support has a plurality of turns forming at least one loops disposed on an exterior surface of the upper.

18 Claims, 7 Drawing Sheets

(56) References Cited

U.S. PATENT DOCUMENTS

| | | | | |
|---|---|---|---|---|
| 8,898,931 | B2 * | 12/2014 | Gerber | A43C 1/04 24/714.7 |
| D725,887 | S | 4/2015 | Bosomworth | |
| D731,773 | S | 6/2015 | Bosomworth et al. | |
| 9,144,263 | B2 * | 9/2015 | Elder | A43B 23/0245 |
| 9,420,851 | B2 | 8/2016 | Klug et al. | |
| 9,861,160 | B2 | 1/2018 | Podhajny et al. | |
| 10,136,701 | B2 | 11/2018 | Klein et al. | |
| 10,194,713 | B2 | 2/2019 | Dimoff et al. | |
| 10,321,738 | B2 | 6/2019 | Lyke et al. | |
| 2011/0041359 | A1 * | 2/2011 | Dojan | A43C 1/00 36/47 |
| 2011/0271556 | A1 * | 11/2011 | Dillenbeck | A43B 7/144 36/43 |
| 2013/0219750 | A1 * | 8/2013 | Dojan | A43C 15/02 36/83 |
| 2014/0130372 | A1 | 5/2014 | Aveni et al. | |
| 2016/0286903 | A1 | 10/2016 | Whewell et al. | |
| 2017/0004226 | A1 | 1/2017 | Skoglund et al. | |
| 2017/0202296 | A1 * | 7/2017 | Fuerst, Jr. | A43B 23/027 |
| 2017/0202309 | A1 * | 7/2017 | Sterman | A43B 23/0235 |
| 2019/0307209 | A1 | 10/2019 | Houng et al. | |
| 2020/0154816 | A1 * | 5/2020 | Gaba | A43B 23/0235 |
| 2020/0345106 | A1 | 11/2020 | McLellan et al. | |

OTHER PUBLICATIONS

Merrell Footwear Fall 2003 International Product Line, p. 11.
Merrell U.S. Autumn/Winter 2011 Footwear, pp. 64-66.
Merrell U.S. Footwear Spring/Summer 2012 Footwear, p. 16.
Merrell Footwear Fall/Winter 2013, pp. 16, 62.
Merrell Footwear Spring/Summer 2015 Buyers Guide, pp. 26-28, 30-31, 33, 75.
Patagonia Footwear Spring 2010 Workbook, pp. 19-20, 22, 24.
Patagonia Footwear Fall 2011 Workbook, pp. 20-22.
Patagonia Footwear Spring 2013 Workbook, p. 22.
Merrell Footwear Summer 2019, p. 33.

* cited by examiner

ARTICLE OF FOOTWEAR WITH LACING SYSTEM

CROSS-REFERENCE TO RELATED APPLICATION(S)

This application is a continuation of U.S. patent application Ser. No. 16/518,044, filed Jul. 22, 2019, which is incorporated herein by reference in its entirety.

BACKGROUND

The present invention relates to footwear, and more particularly to footwear having an upper and a lacing system.

Conventional articles of footwear include an upper and a sole secured to a lower surface of the upper. The upper provides a void that receives a person's foot and positions the foot with respect to the sole. The sole may provide traction or cushion for the foot under a variety of conditions, e.g., walking, running or standing, or a combination thereof, and commonly includes a midsole and an outsole. A footbed or insole typically is disposed in the interior of the upper for additional cushion.

Some articles of footwear include a lacing system to provide a snug and comfortable fit of the upper around the wearer's foot. The lacing system secures the wearer's foot so that parts of the footwear are pulled inward, with a lace over the instep, against the lateral and medial sides of the wearer's foot in the arch region. A lacing system can be limited based on the size of the upper in relation to the wearer's foot. It also can be difficult to accommodate a multitude of possible variations of foot sizes with a single type of lacing system. Further, due to excessive forces generated by tension in laces of a lacing system, the components of the lacing system can stretch and/or move, or can become uncomfortably tight over a wearer's foot. Over time, parts of the lacing system can stretch or deteriorate, and in some cases detach from the sole or upper, so that even when the lacing system is tightened, the upper does not thoroughly secure around the wearer's foot.

Accordingly, there remains room for improvement to lacing systems in the field of footwear.

SUMMARY OF THE INVENTION

An article of footwear is provided with a lacing system configured to secure the footwear to the wearer's foot and to distribute tension across a wide area of the upper, which helps prevent stretching, ripping and/or excessive tension in parts of the footwear, and which provides a robust construction having a secure fit around the wearer's foot.

In one embodiment, an article of footwear includes an upper that defines a foot void configured to receive a wearer's foot. The upper includes an exterior surface having a lateral side and a medial side, and a lacing cord on the exterior surface of the upper, the lacing cord extending back and forth on the upper to define at least one V-shaped lower turn fixedly attached to the exterior surface of the upper by embroidery stitching, the embroidery stitching including stiches crossing over and under and the lacing cord and at least one V-shaped upper turn, the V-shaped upper turn having an upper end forming a loop that is free from attachment to the upper, wherein the V-shaped lower turn includes a first portion disposed on a first point of the upper, a second portion disposed on a second point of the upper, the second point spaced form the first point, and the embroidering stitching extends along the length of the lacing cord between the first and second points.

In still another embodiment, the lacing cord can be reinforced with additional stitching on the upper.

In yet another embodiment, the upper can include a knitted layer and a liner layer disposed inwardly of the knitted layer. The lacing cord can be embroidered to the knitted layer using embroidery thread. The liner can cover the embroidery thread on an inner surface of knitted layer.

In even another embodiment, the upper can include a knitted layer having regions of different elasticity and/or air permeability. The lacing cord can be embroidered to region of lower elasticity and/or air permeability. The lacing cord can be embroidered to a region of higher elasticity and/or air permeability, or across different regions.

In still a further embodiment, the footwear upper can include an exterior surface having a lateral side and a medial side, and a lacing system including a primary lace support connected to the upper and having primary loops disposed on the lateral and medial sides of the exterior surface of the upper. The primary lace support can include a primary lacing cord having a first segment embroidered to the upper, a second segment embroidered to the upper, and a third segment free from attachment to the upper between the first and second segments. The third segment can form one of the primary loops.

The current embodiments described herein can provide an article of footwear having an exceptional fit and finish that were not previously achievable. With the primary and secondary lace support systems, and the optional lace, the footwear upper can provide an exceptionally dynamic fit to a wearer's foot. Where the primary lace support is embroidered to the upper over a lateral and/or medial panel, that support can distribute forces in an efficient manner Where the upper is knitted, the distribution of forces over the lateral and/or medial panels can be preselected and fine-tuned to provide exceptional fit without feeling overtightened on the wearer's foot. The forces can also be distributed such that the upper panels are not put under excessive tension so that they are not damaged or torn due to forces transmitted through the support systems to secure the upper to a wearer's foot.

These and other objects, advantages and features of the invention will be more readily understood and appreciated by reference to the detailed description of the preferred embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
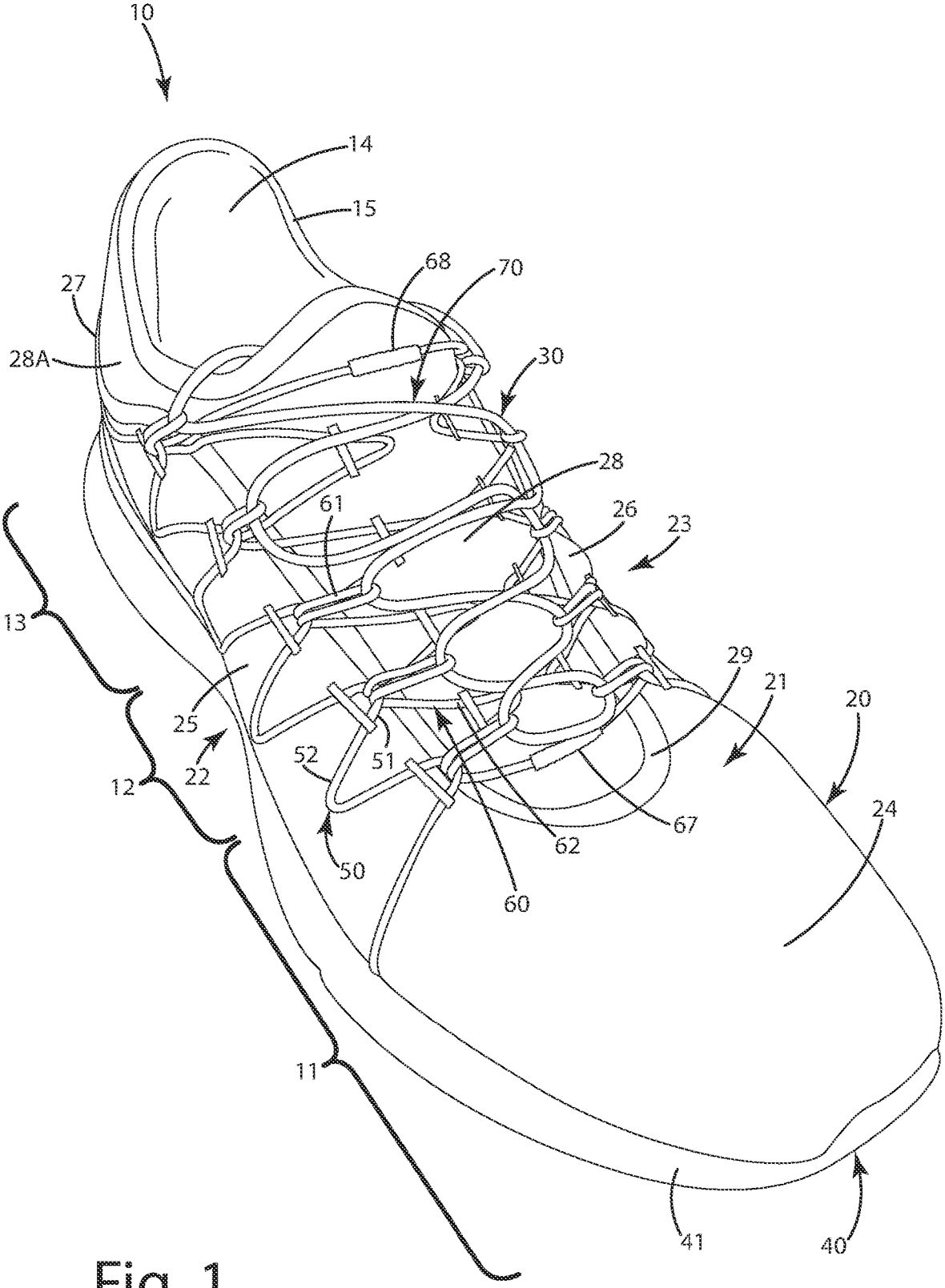
FIG. 1 is a front perspective view of an article of footwear including a lacing system in accordance with a current embodiment.

A current embodiment of the footwear is illustrated in FIGS. 1-7 and generally designated 10. Generally, the footwear 10 includes an upper 20 having a lacing system 30, and a sole 40 joined with the upper 20. The lacing system 30 is configured to secure the footwear 10 to the wearer's foot and includes a primary lace support 50 having a plurality of primary loops 51, a secondary lace support 60 having portions thereof inserted through the primary loops 51 to form a plurality of secondary loops 61, and a lace 70 extending through the secondary loops 61. When the lace 70 is tightened, the tension on the lacing supports 50, 60 is distributed across a wide area of the upper 20, which helps prevent stretching, ripping, or pulling of the parts of the footwear 10 and provides a robust construction and a secure fit of the upper 20 around the wearer's foot. Exemplary lace supports 50, 60 are formed using embroidered cords 52, 62 on the upper 20. In one embodiment, the upper 20 can be a three-dimensional structure formed through a flat knitting process, and the lacing cords 52, 62 are embroidered to the upper 20.

Although the current embodiments are illustrated in the context of a running shoe, they may be incorporated into any type or style of footwear, including hiking shoes, trail shoes and boots, hiking boots, work boots, all-terrain shoes, barefoot running shoes, athletic shoes, performance shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations.

Further, the terms "medial," "lateral" and "longitudinal" are used in the manner commonly used in connection with footwear. For example, when used in referring to a side of the shoe, the term "medial" refers to the inward side (that is, the side facing footwear on the wearer's other foot) and "lateral" refers to the outward side. When used in referring to a direction, the term "longitudinal direction" refers to a direction generally extending along the length of the footwear between toe and heel, and the term "lateral direction" refers to a direction generally extending across the width of the footwear between the medial and lateral sides of the footwear. The use of directional terms should not be interpreted to limit the invention to any specific orientation. Further, as used herein, the term "arch region" (or arch or midfoot) refers generally to the portion of the footwear corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 11, arch or mid-foot region 12, and heel region 13 generally are identified in FIG. 1. The upper 20 and sole 40 each have a corresponding forefoot portion, arch region or mid-foot portion, and heel portion within these regions 11-13. However, it is to be understood that delineation of these regions may vary depending upon the configuration of the sole assembly and/or footwear.

The footwear 10 includes a foot void 14, defined by the upper 20 and sole 40, configured to securely and comfortably hold a human foot. The foot is received through a foot opening 15 defined by the upper 20. A footbed (not shown) can be positioned within the void 14 defined by the upper.

The sole 40 can include one or more different components, such as an outsole 41 configured to include a ground contacting surface which itself may include multiple treads, lugs, spikes, cleats and/or other features designed to enhance traction between the footwear 10 and in underlying surface. Other components such as a midsole and/or a topsole (not shown) can be included. The components of the sole 40 can individually and/or collectively provide the article of footwear 10 with a number of attributes, such as support, rigidity, flexibility, stability, cushioning, comfort, reduced weight, and/or other attributes. Generally, regardless of which components are present, the sole 40 can form the bottommost portion of the footwear 10.

The sole 40 may be joined to the upper 20 using essentially any type of footwear construction, such as a cemented construction, a direct-attach construction (e.g. direct injection molding), a Strobel-stitched construction, a stitchdown construction, a McKay stitch construction, a California construction, a force-lasted construction, a slip-lasted construction, a moccasin construction, a direct vulcanizing construction or a welted construction (e.g. Goodyear welt or Blake welt). The upper 20 may be configured to implement the desired footwear construction. For example, the bottom of the upper 20 may be closed with a Strobel-board to implement a Strobel-stitched construction or with an insole board to implement a direct-attached or welted construction. The joining of the sole 40 and the upper 20 can be accomplished using adhesives, cement, injection molding, pour molding or any other technique used to join an upper and sole.

The upper 20 can be formed from one or more material elements joined together to cover at least a portion of the wearer's foot. The upper 20 can be manufactured from nylon, natural or synthetic leather, canvas, cotton, nonwoven fabric, plastic sheets, or other suitable materials. The material elements can be selected based on the intended uses of the article of footwear 10. In some embodiments, the upper 20 can be manufactured from any material upon which the lace supports 50, 60 can be embroidered or stitched in place.

In one embodiment, the upper 20 can be in the form of a knitted upper, constructed for example by weaving or knitting techniques, such as circular knitting, flat knitting, raschel knitting, Jacquard knitting or other types of knitting. Optionally, the upper 20 can be knitted with two or more different knit patterns. Certain knit patterns can be disposed in certain regions to impart various physical attributes, such as breathability, rigidity, support, elasticity, and/or to mimic a heel counter, toe guard, or other component. With regard to knit patterns, the strands forming the knitted textile of the upper 20 may have one type of knit pattern in one area and another type of knit pattern in another area. Depending upon the types and combinations of knit patterns utilized, areas of the knitted textile can have a plain knit structure, a mesh knit structure, a rib knit structure, and various combinations thereof, for example. Different types of knit patterns can be incorporated into specific locations of the upper 20 to modify the physical properties or aesthetics of the upper 20, such as elasticity, air permeability, stiffness, and abrasion-resistance.

Optionally, the upper 20 can have one type of yarn formed from multiple strands, optionally twisted together, in one area and another type of yarn in another area. The upper 20 also can incorporate yarns with different deniers, materials (e.g., cotton, elastane, polyester, rayon, wool, nylon and mixtures thereof), and degrees of twist. The different types of yarns can affect the physical properties of the upper 20, including aesthetics, stretch, thickness, air permeability, and abrasion-resistance. By varying and/or combining various types and combinations of knit patterns and yarns, each area of the upper 20 may have specific properties that enhance the comfort, durability, and performance of the footwear 10.

Figure 2:
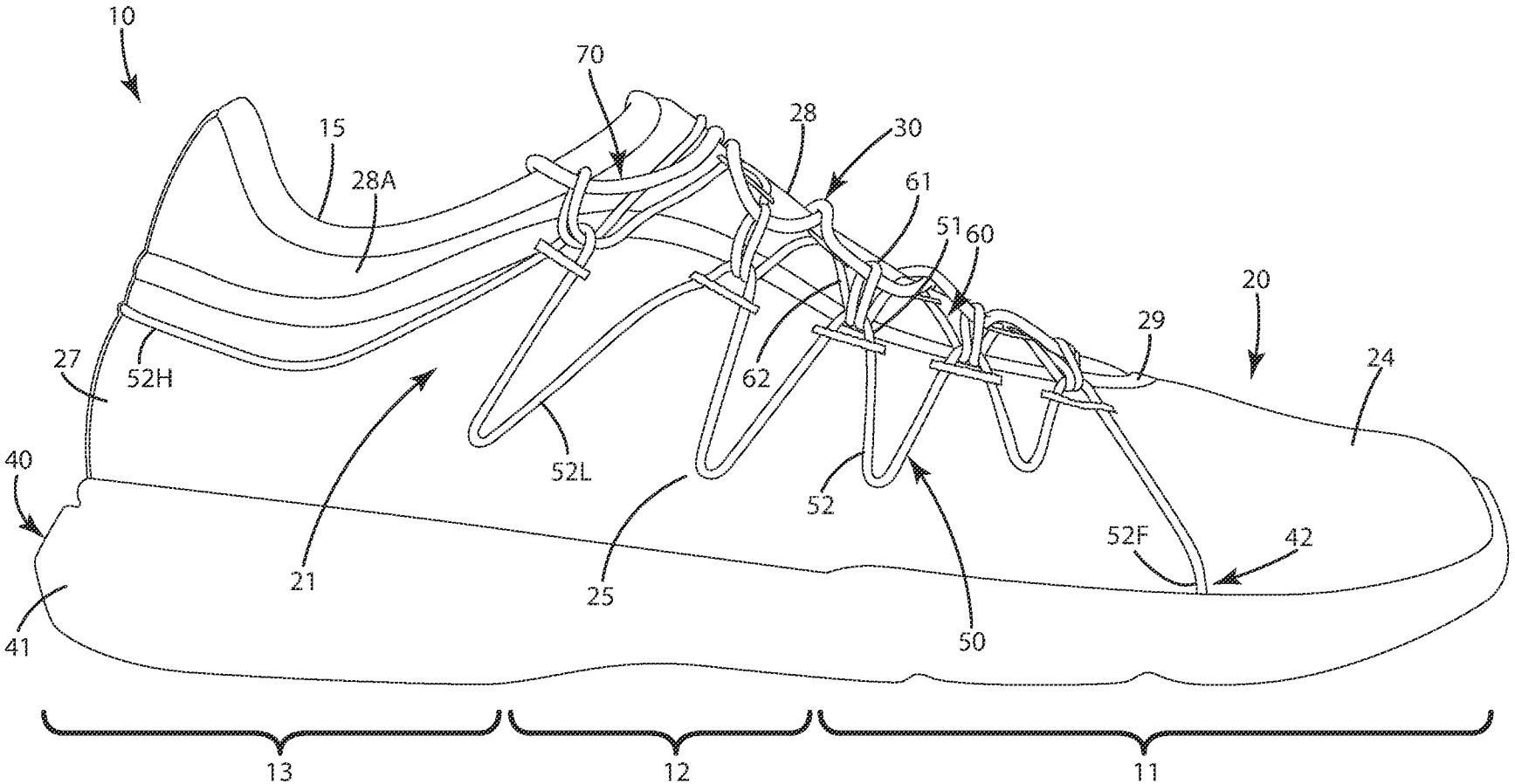
FIG. 2 is a lateral side view of the footwear of FIG. 1.

Referring to FIGS. 1 and 2, the upper 20 can include an exterior surface 21 with a lateral side 22 and a medial side 23. The lace supports 50, 60 can extend over the exterior surface 21, on the lateral and medial sides 22, 23. Although the construction of the upper 20 may vary, the upper 20 of the illustrated embodiment generally includes a vamp 24 (or toe box) joined with one or more quarters or panels, including a lateral panel 25 along the lateral side 22, a medial panel 26 along the medial side 23, and a heel panel 27. The vamp 24 generally forms the forefoot portion of the upper 20 and the panels 25-27 form the arch and heel portions of the upper 20. An instep panel 28 extends between the vamp 24, lateral panel 25, and medial panel 26, generally the over the wearer's instep, and optionally includes a portion 28A encircling and defining the foot opening 15. In other embodiments, the panels 25-27 can define at least a portion of the foot opening 15.

The various pieces of the upper 20 may be manufactured from any combination of pieces of a wide range of materials, such as leather, synthetic leather, mesh, canvas, textile (e.g. woven, knit, bonded), fabric and molded components. In the embodiment illustrated herein, the vamp 24, lateral panel 25, medial panel 26, and heel panel 27 are contiguous and form a unitary knitted textile, and is formed as a one-piece element through a knitting process. That is, the knitting process substantially forms the various shapes and structures of the vamp 24, lateral panel 25, medial panel 26, and heel panel 27 without the need for significant additional manufacturing steps or processes. Portions and edges of the knitted textile may be joined to each other (e.g., a seam may join portions of the knitted textile forming the heel panel 27) following the knitting process.

The instep panel 28 can be formed from a separate textile piece, and is sewn otherwise joined to the vamp 24, lateral panel 25, and medial panel 26 along a seam 29. In other embodiments, the instep panel 28 can be formed as a unitary knitted textile with the other panels. In yet other embodiments, the upper 20 can be a multi-piece upper with the vamp 24, lateral panel 25, medial panel 26, heel panel 27, and instep panel 28 sewn or otherwise joined together.

A variety of additional elements may be incorporated into the upper 20. For example, the upper 20 may include various trim, cushioning and reinforcing elements, such as, but not limited to, a binding collar topline providing a finished edge to the foot opening 15, a toe bumper (not shown) provided to reinforce the vamp 24, a heel counter (not shown) be fitted into the heel region to reinforce the heel panel 27 and increase support, and/or one or more logos, trademarks, and/or placards with care instructions and material information. Accordingly, the upper 20 may incorporate a variety of other features and elements, in addition to the features and elements discussed herein and shown in the figures.

As shown in FIG. 1-2, the lace 70 cooperates with the lace supports 50, 60 to adjust the fit of the upper 20 around the wearer's foot. For example, the lace 70 can be tightened to cinch the upper 20 around the wearer's foot, and tied once a desired fit of the upper 20 around the wearer's foot is attained. The lace 70 also permits the wearer to loosen upper 20 and facilitate removal of the foot from the void 14. The ends of the lace 70 can be tied together around the foot (e.g., in a bow or a knot).

The lace 70 can be continuous and optionally can be in the form of a strand, a cable, a solid core wire, a solid core polymer, a multi-filament layer or polymer, which can be braided, woven, twisted or otherwise configured, a strap, a cord, a filament and combinations of any of the foregoing. The lace 70 can be combined with others laces or strands. Some laces can include wire and/or a synthetic material such as nylon, rayon, polyester and/or a polyacrylic compound.

As best shown in FIG. 1, the lace 70 can be disposed over the instep panel 28 of the upper 20, and can extend to and fro between the medial and lateral sides 22, 23 of the upper 20, upward toward the foot opening 15. The lace 70 can be wound through or otherwise interfaced with the secondary loops 61 in a variety of different lacing configurations to provide a desired movement or spatial orientation of the upper 20 to enclose and envelop a wearer's foot disposed in the foot void 14. FIG. 1 shows one possible lacing configuration in which the lace 70 extends through each of the secondary loops 61, crisscrossing back and forth between the lateral side 22 and medial side 23 of the upper 20. In other lacing configurations, the lace 70 can extend through any combination or subset of the secondary loops 61, in various sequences.

Figure 3:
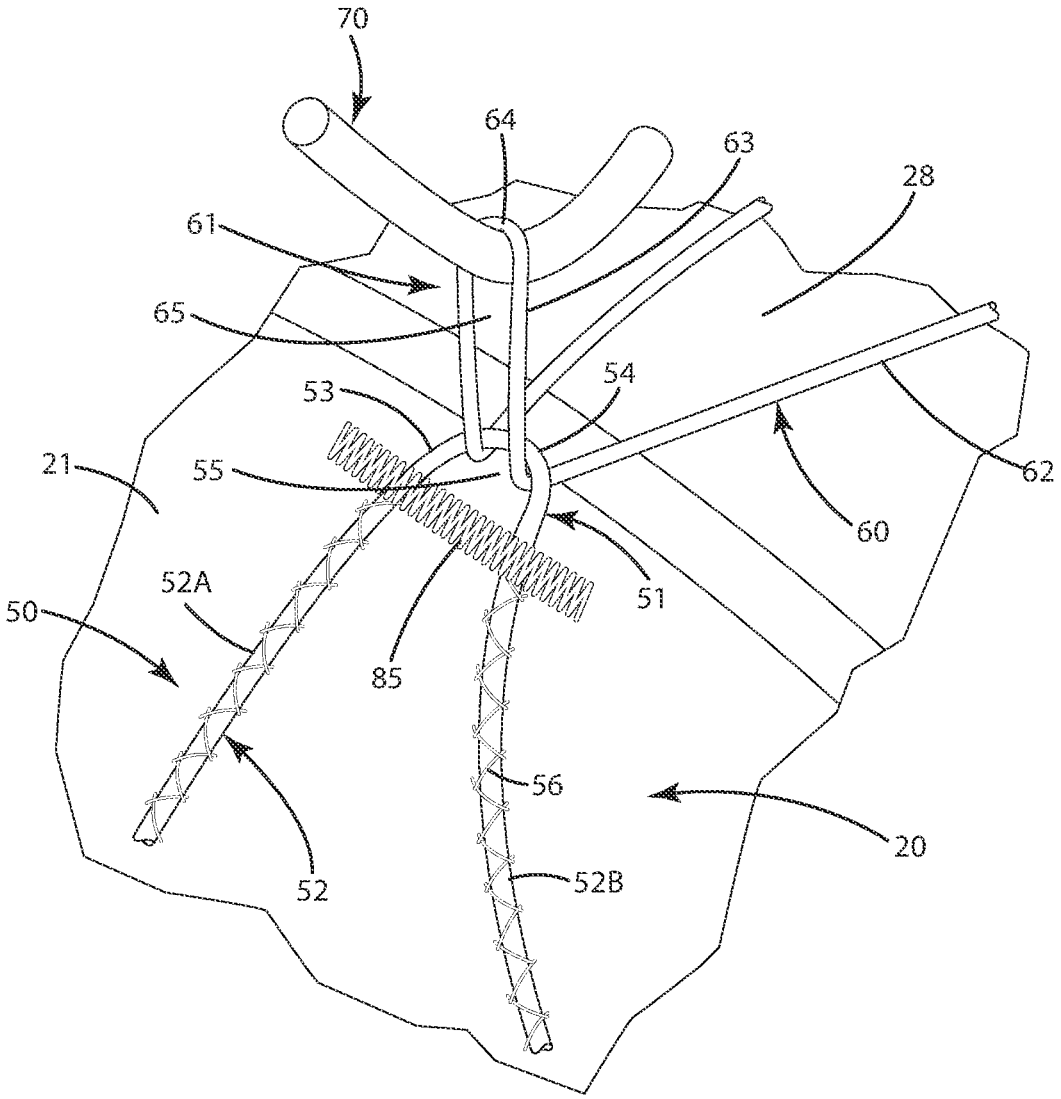
FIG. 3 is a close-up view showing a portion of the lacing system.

FIG. 3 is a close-up view showing a portion of the lace supports 50, 60 and lace 70 of the lacing system 30. The primary and secondary lace supports 50, 60 may be formed from one or more laces or cords. Each lace or cord may include a strand, string, twine, yarn, rope, filament, cable, webbing, and/or other elongated, cord-like structures, including combinations of any of the foregoing braided, twisted together, or otherwise combined. Each lace or cord can be continuous from end-to-end, or can be combined with others laces or cords. Some non-limiting examples of materials for the lace or cord can include natural or synthetic materials, such as nylon, rayon, polyester and/or a polyacrylic compound. Some non-limiting examples of cross-sectional shapes for the lace or cord can include round or flat.

In the embodiment illustrated in the figures, the primary and secondary lace supports 50, 60 are formed by lacing cords 52, 62, respectively. The material and/or shape for the lacing cord 52 forming the primary lace support 50 may be the same as or different from the material and/or shape for the lacing cord 62 forming the secondary lace support 60. In one example, the lacing cords 52, 62 are both braided nylon cords.

The primary and secondary lace supports 50, 60 can include portions that are attached directly to the exterior surface 21 of the upper 20. The loops 51, 61 extend from the exterior surface 21 of the upper 20, and are free from attachment to the upper 20, i.e. the surfaces of the loops 51, 61 are separated by a gap from the exterior surface 21, and can bend and flex to accommodate the lace 70 and the desired fit of the upper 20 on the wearer's foot.

The lace 70 can interlock the secondary lace support 60 with the primary lace support 50, and can prevent the secondary loops 61 from accidentally unlooping by hindering the secondary lacing cord 62 from withdrawing completely from the primary loops 51. When the lace 70 is tightened and tied, the tension on the interlocked lacing cords 52, 62 is increased and the secondary lacing cord 62 cannot withdraw from the primary loops 51.

The primary lacing cord 52 includes a plurality of looped sections 53 forming the primary loops 51. Each of the looped sections 53 includes a length or segment of the primary lacing cord 52 extending from the exterior 21 of the upper 20 at each end thereof, with a bend between the attached ends forming a terminal end 54 of the loop 51. Each looped section 53 can be routed away from the exterior 21, bent at the terminal end 54 and routed back toward the exterior 21, with the ends thereof secured on the exterior 21, e.g., via embroidery using thread 56, stitching, adhesive, etc., as described in further detail below, to form the primary loop 51 and defines an opening 55 operable to permit passage of the secondary loops 61 therethrough.

One of the primary loops 51 can be bordered by segments of the primary lacing cord 52 attached to the upper 20. For example, the primary loop 51 can be formed by a first segment 52A of the primary lacing cord 52 attached to the upper 20 and a second segment 52B of the primary lacing cord 52 attached to the upper 20, with the looped section 53 forming a third segment free from attachment to the upper 20 between the first and second segments 52A, 52B. As detailed below, in one embodiment, the first and second segments 52A, 52B can be embroidered to the upper 20 using thread 56.

The secondary lacing cord 62 includes a plurality of looped sections 63 forming the secondary loops 61. Each of the looped sections 63 includes a length or segment of the secondary lacing cord 62 extending from the exterior 21 of the upper 20, such as from the instep panel 28 at each end thereof, with a bend between the attached ends forming a terminal end 64 of the loop 61. Each looped section 53 can be routed away from the exterior 21, bent at the terminal end 64 and routed back toward the exterior 21, with the ends thereof secured on the exterior 21, e.g., via embroidery using thread 66, stitching, adhesive, etc., as described in further detail below, to form a looped section 63 which can be passed through one of the primary loops 51 to define the secondary loop 61 at its terminal end 64. Each secondary loop 61 defines an opening 65 operable to permit passage of the lace 70 through the secondary loop 61.

Figure 6:
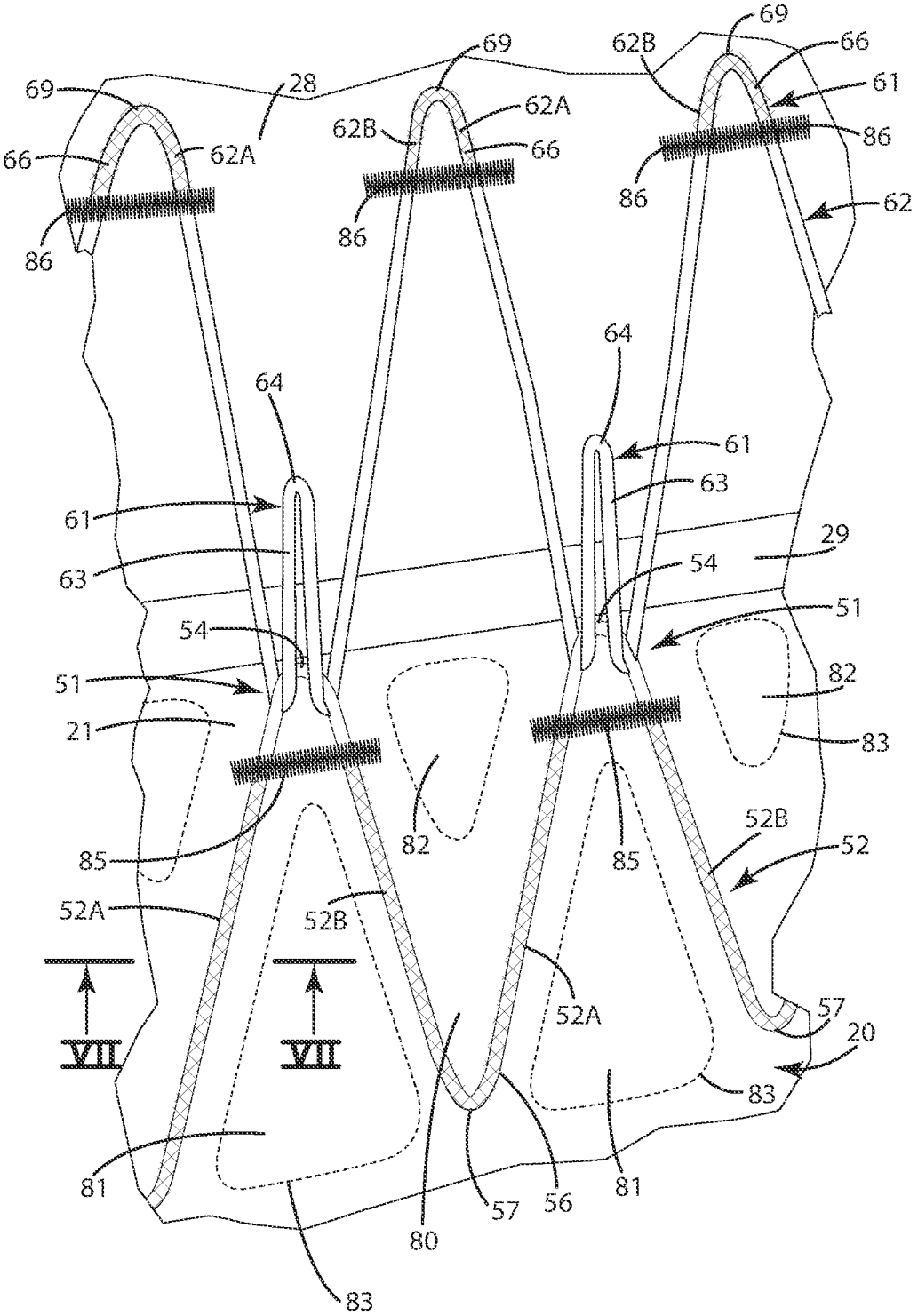
FIG. 6 is a close-up view of section VI of FIG. 5.

One of the secondary loop 61 can be bordered by segments of the secondary lacing cord 62 attached to the upper 20. For example, as shown in FIG. 6, the secondary loop 61 can be formed by a first segment 62A of the secondary lacing cord 62 attached to the upper 20 and a second segment 62B of the secondary lacing cord 62 attached to the upper 20, with the looped section 63 forming a third segment free from attachment to the upper 20 between the first and second segments 62A, 62B. As detailed below, in one embodiment, the first and second segments 62A, 62B can be embroidered to the upper 20 using thread 66.

In one embodiment, the secondary lacing cord 62 is interlocked with the primary lacing cord 52 by the lace 70, as depicted in FIG. 3. The looped sections 63 of the secondary lacing cord 62 extend through the openings 55 formed by the primary loops 51, with the portion of the looped sections 63 extending beyond the primary lacing cord 52 defining the secondary loops 61. The lace 70 extends through the openings 65 formed by the secondary loops 61. Under tension, the lace 70 pulls against the terminal ends 64 of the secondary loops 61, and the looped sections 63 are in turn pulled against the terminal ends 54 of the primary loops 51. Due to the interlocked configuration lace supports 50, 60, tension on the looped sections 63 is distributed to multiple locations on the upper 20, including to the locations where the lacing cords 52, 62 are directly attached, i.e. embroidered, to the upper 20.

The secondary loops 61 can be slidably adjustable within the primary loops 51 to adjust the fit of the article of footwear 10 to the wearer's foot. In FIG. 3, the secondary looped sections 63 are depicted as curved around the primary lacing cord 52. The looped sections 63 can be elongated for adjusting the fit of the upper 20 around the wearer's foot. For example, the looped section 63 can be pulled farther through the primary loop 51 to cinch down the lace 70 for a narrower fit. The secondary lace support 60 can also be relaxed so that less of the looped section 63 is pulled through the primary loop 51 for a wider fit.

Figure 4:
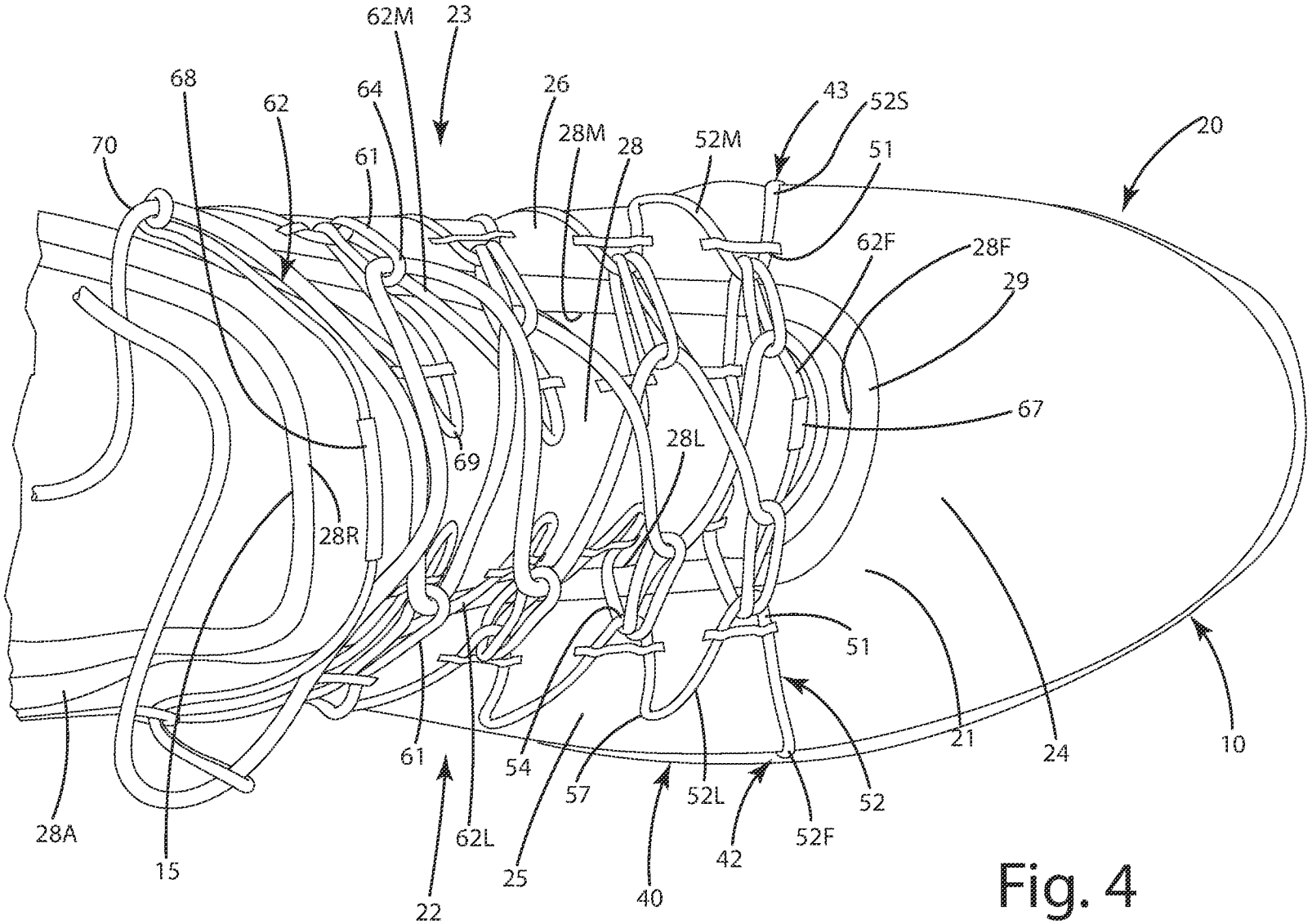
FIG. 4 is a top view of a forefoot portion of the footwear of FIG. 1.

Referring to FIG. 4, a top view of a forefoot portion of the footwear 10 is shown. The instep panel 28 includes a lateral edge 28L, a medial edge 28M, a forward edge 28F, and a rearward edge 28R. The instep panel 28 spans the dorsum of the midfoot (i.e. the instep), extending from the lateral panel 25 at its lateral edge 28L to the medial panel 26 at its medial edge 28M, and extending from the vamp 24 at its forward edge 28F to the foot opening 15 at its rearward edge 28R, which optionally joins the portion 28A encircling and defining the foot opening 15. The width of the instep panel 28, i.e., the dimension of the panel between its lateral and medial edges 28L, 28M, can be generally uniform or can change, such as by increasing toward the foot opening 15. While not shown herein, the instep panel 28 can optionally include a tongue that provides cushioning and support across the instep of the foot.

The primary lacing cord 52 has a first end 52F and a second end 52S, and the lacing cord 52 can be continuous or discontinuous, i.e. formed from one or more segments of lacing cord, between the first and second ends 52F, 52S. In the embodiment shown herein, the primary lacing cord 52 includes an elongated lateral segment 52L extending over the lateral side 22 of the upper 20 and defining the primary loops 51 thereon, and an elongated medial segment 52M extending over the medial side 23 of the upper 20 and defining the primary loops 51 thereon. Referring additionally to FIG. 2, the primary lacing cord 52 can include an elongated heel segment 52H extending around the heel panel 27 of the upper 20, generally between the lateral and medial segments 52L, 52M. The lacing cord 52 can extend continuously or discontinuously between the segments 52L, 52M, 52H, from the first end 52F to the second end 52S.

The primary loops 51 can be attached at the lateral side 22 and medial side 23 of the exterior surface 21, and extend free of the upper 20 toward the center of the footwear 10 or the instep panel 28. A set of primary loops 51 can be disposed on both the lateral side 22 and medial side 23 of the exterior surface 21 of the upper 20, with the lateral segment 52L of the lacing cord 52 forming a lateral set of primary loops 51 and the medial segment 52M of the lacing cord 52 forming a medial set of primary loops 51.

The first and second ends 52F, 52S of the primary lacing cord 52 can be attached to the upper 20 or sole 40 of the footwear 10 using any suitable attachment method, including, but not limited to, embroidery, stitching, adhesive, welding, fusing, or any combination thereof. In the embodiment shown in FIG. 4, the first end 52F secured to a first connection point 42 at the sole 40 on the lateral side 22 of the upper 20 and the second end 52S secured to a second connection point 43 at the sole 40 on the medial side 23 of the upper 20. The entire lacing cord 52, or substantially the entire lacing cord 52 between the ends 52F, 52S joined to the sole 40, can be disposed on the exterior surface 21 of the upper 20.

The secondary lacing cord 62 includes an elongated lateral segment 62L defining the secondary loops 61 on the lateral side 22 of the upper 20 and an elongated medial segment 62M defining the secondary loops 61 on the medial side 23 of the upper 20. The secondary lacing cord 62 can include a first end 62F and a second end 62S, the first end 62F secured to a first connection point 67 disposed adjacent the forward edge 28F of the instep panel 28 and the second end secured 62S to a second connection point 68 disposed adjacent the rearward edge 28R of the instep panel 28. The secondary lacing cord 62 can be provided as a continuous loop around the upper 20 between the first and second ends 62F, 62S, with the first and second ends 62F, 62S formed as elongated segments of lacing cord 62 which extend laterally and medially from the connection points 67, 68 to join the lateral and segments 62L, 62M. The connection points 67, 68 can be centered on the instep panel 28 and spaced longitudinally or lengthwise on the upper 20.

The secondary loops 61 can be attached at the instep panel 28 and extend free of the upper 20 toward one of the lateral or medial sides 22, 23 of the upper 20. The secondary loops 61 are formed by inserting a portion of the lacing cord 62 through one of the primary loops 51, for example as described above with respect to FIG. 3. A set of secondary loops 61 can be disposed on both the lateral side 22 and medial side 23 of the exterior surface 21 of the upper 20, with the lateral segment 62L of the lacing cord 62 forming a lateral set of secondary loops 61 and the medial segment 62M of the lacing cord 62 forming a medial set of secondary loops 61.

In the illustrated embodiment, the secondary lace support 60 is attached to the instep panel 28. Optionally, the secondary lace support 60 can be attached to a tongue of the instep panel 28 that provides cushioning and support across the instep of the foot.

Figure 5:
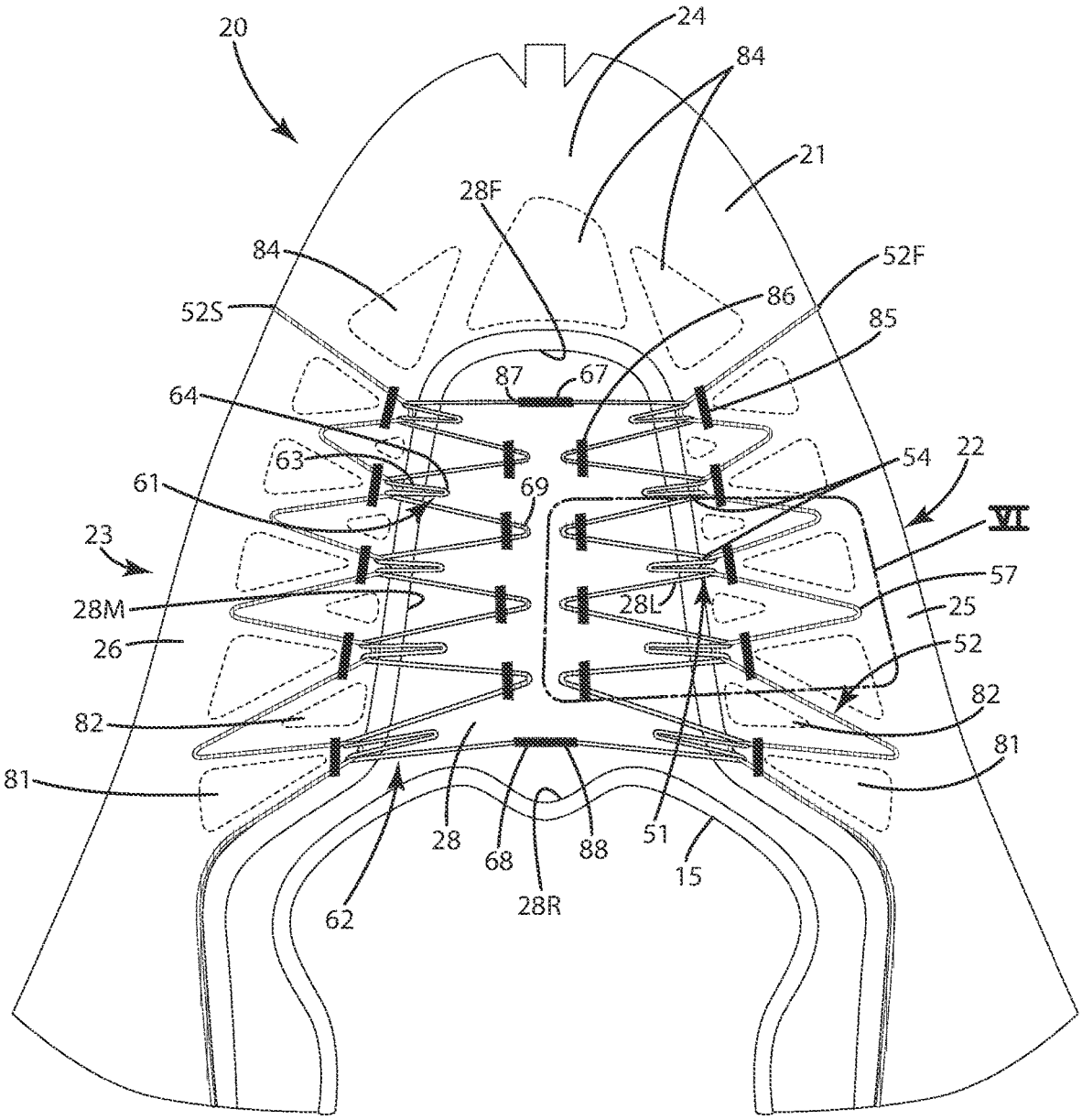
FIG. 5 is a top plan view of a portion of an upper for the footwear of FIG. 1, illustrating lace supports for the lacing system.

Referring to FIG. 5, a top plan view of a portion of the upper 20 is shown. The lace 70 (FIG. 1) is not shown in FIG. 5 for clarity. The lacing cords 52, 62 can extend over the exterior 21 of the upper in various patterns to form the loops 51, 62. One embodiment of a loop pattern is shown in FIG. 5. As illustrated, the primary loops 51 of the primary lacing cord 52 are linearly spaced, being generally aligned in a first row on the lateral panel 25 extending in the longitudinal or lengthwise direction of the upper 20 and in a second row on the medial panel 26 extending in the longitudinal or lengthwise direction of the upper 20. Further, as depicted in the drawings, the primary loops 51 formed on each side extend in a generally inward direction, or toward the instep panel 28, toward their respective terminal ends 54. The terminal ends 54 are disposed along the outside of the lateral and medial edges 28L, 28M of the instep panel 28.

As illustrated, the secondary loops 61 of the secondary lacing cord 62 are linearly spaced, being generally aligned in rows extending in the longitudinal or lengthwise direction of the upper 20. Further, as depicted in the drawings, the looped sections 63 formed on the lateral side 22 extend laterally across the lateral edge 28L of the instep panel 28, toward their respective terminal ends 64. The looped sections 63 formed on the medial side of the instep panel 28 extend medially across the medial edge 28M of the instep panel 28, toward their respective terminal ends 64. When threaded through the primary loops 51, the looped sections 63 turn back toward the center of the instep panel 28, and may optionally re-cross the lateral or medial edge 28L, 28M of the instep panel 28.

Referring to the embodiment shown in FIGS. 3 and 6, the lacing cord 52, 62 can be embroidered to the upper 20 using thread 56, 66, respectively. Embroidering the lacing cord 52, 62 to the upper 20 comprises stitching a portion or length of the lacing cord 52, 62 in place with thread 56, 66. Hand- or machine-embroidery may be used. Alternative methods for attaching the lace supports 50, 60 to the upper 20 include stitching, adhesive, welding, and fusing. Combinations of attachment methods can also be used. For example, the lacing cord 52, 62 can be adhered, welded, or fused to the upper 20 as a first attachment, and embroidered in place over the first attachment.

In some embodiments, the lacing cord 52, 62 can be attached to the upper 20 by applying embroidery stitches along a length or segment of the lacing cord 52, 62, or at discrete locations along the lacing cord 52, 62, such as at two spaced locations along the length of the cord. For example, embroidery stitches can be applied along segments 52A, 52B of the primary lacing cord 52 using thread 56. Embroidery stitches can be applied along segments 62A, 62B of the secondary lacing cord 52 using thread 66. The embroidery stitches may secure the lacing cord 52, 62 to one or more layers of the upper 20, and adjacent the exterior surface 21 of the upper 20 to be visible to the wearer. The thread 56, 66 can be routed through one or more layers of the upper 20 to embroider the lacing cord 52, 62 to the upper 20.

As used herein, the embroidery thread 56, 66 can include various threads, yarns, or other strands of material, including single fiber, monofilament, or multi-filament threads. Some non-limiting examples of materials for the thread 56, 66 used for embroidering the lacing cords 52, 62 to the upper 20 can include polymer materials such nylon, polyester, polyacrylic, polypropylene, polyethylene, metal, silk, cellulosic fibers (e.g., cotton), elastomers, and any combination, composite, or blend thereof. The thread 56, 66 forming the embroidery stitches for the first and second lacing cords 52, 62 may be formed of the same or different materials.

The stitch technique for embroidering the lacing cords 52, 62 to the upper 20 can vary. In some non-limiting examples, the stitch technique used can include chain stitch, double chain stitch, the buttonhole or blanket stitch, the running stitch, the satin stitch, the cross stitch, or any other conventional stitch technique. A combination of known stitch techniques can be used.

In one method of attaching the lacing cord 52, 62 to the upper 20, the lacing cord 52, 62 can be laid onto the exterior surface 21 of the upper 20, and embroidered or stitched in place using thread 56, 66. Optionally, the exterior surface 21 of the upper 20 is formed as the exterior surface of a flat-knitted textile, which can conveniently be laid flat during embroidery. In an exemplary embodiment, an embroidery machine can be used to stitch thread 56, 66 using a needle that routes thread 56, 66 through openings in the knitted textile, or directly through yarn or strands of the material, or other material, such as polymer sheets, weaves, fabrics, leather panels or other panels forming the upper 20. In other embodiments, the needle can pierce the upper 20 to create its own opening in the upper 20 and stitches thread 56, 66 through the resulting holes. In either case, the thread 56, 66 can extends over at least a portion of the lacing cord 52, 62 between two openings in the upper 20 to attach the lacing cord 52, 62 to the exterior surface 21 of the upper 20. By extending over at least a portion of the lacing cord 56, 62, the thread 56, 66 can extend over an outer surface of the lacing cord 52, 62 as shown herein. As another option, the thread 56, 66 can extend through the lacing cord 56, 62 to extend over a portion of the lacing cord 52, 62 closest to the exterior surface 21 of the upper 20. In the latter case, the thread 56, 62 can penetrate an outer surface of the lacing cord 52, 62 and emerges at another location on the lacing cord 52, 62.

After the cords 52, 62 are embroidered or stitched in place using thread 56, 66, the outer surface of the cord 52, 62 can engage against the exterior surface 21 of the upper 20, but is non-slidable and substantially immovable relative to the exterior surface 21 where the embroidery thread 56, 66 goes over or through the cords 52, 62.

FIG. 6 illustrates that, in this embodiment, lacing cord 52, 62 is repeatedly stitched along elongated segments to extend across the exterior surface 21 of the upper 20 according to a desired pattern of the lace support 50, 60. In some cases, the lacing cords 52, 62 may be embroidered onto the upper 20 in a generally continuous manner for a generally continuous lace support. In other cases, lacing cords 52, 62 can be cut or divided into multiple sections during the embroidering process, such that the lace supports 50, 60 are discontinuous. In both instances, the lacing cords 52, 62 may be embroidered onto the upper 20 using a single thread or multiple threads.

The lacing cords 52, 62 can be both functional and decorative. For example, in addition to forming the loops 51, 61 for the lacing system 30, the lacing cords 52, 62 can be embroidered in various decorative patterns on the upper 20, including letters, numbers, symbols, other characters, or any combination thereof.

In the illustrated embodiment, the primary lacing cord 52 and secondary lacing cords 62 can extend in zigzag, sinuous, serpentine, or otherwise alternating patterns over the upper 20. For example, the primary lacing cord 52 can have portions extending in a zigzag or back-and-forth manner between upper and lower ends of the lateral and medial panels 25, 26 of the upper 20 to order to define the terminal ends 54 of the primary loops 51 at the upper end or turn. At the lower end or turn, the primary lacing cord 52 can define a lower end 57 distal from the terminal end 54 of the loop 51.

The second segment 52B associated with one loop 51 can be joined to or continuous with the first segment 52A associated with an adjacent loop 51. The lacing cord 52 can transition from one segment 52B to the other segment 52A at the lower end 57. The lacing cord 52 can be continuously embroidered between these segments, including over the transition between the segments 52B, 52A and the lower end 57.

The exemplary embodiment uses triangular loops 51 formed by elongated segments 52A, 52B of embroidered lacing cord 52 to help transfer tension across a larger area of the upper 20. As seen in FIG. 6, each embroidered segment 52A, 52B extends away from the terminal end 54 at an angle. With this arrangement, as the secondary lacing cord 62 pulls on the loop 51, tension is directed from the loop 51 to the embroidery, and then to the upper 20. The divergence of the embroidered segments 52A, 52B spreads the force over a wider area of the upper 20, and helps prevent the upper 20 from stretching, ripping, etc. and helps prevent the loops 51 from pulling away from the upper 20.

The secondary lacing cord 62 can have portions extending in a zigzag or back-and-forth manner across the upper 20, such as across the instep panel 28, to order to define the terminal ends 64 of the looped segments 63 at the outer end or turn. At the inner end or turn, the secondary lacking cord 62 can define an upper end 69 distal from the looped segments 63.

The second segment 62B associated with one loop 61 can be joined to or continuous with the first segment 62A associated with an adjacent loop 61. The lacing cord 62 can transition from one segment 52B to the other segment 62A at the upper end 69. The lacing cord 62 can be continuously embroidered between these segments, including over the transition between the segments 62B, 62A and the upper end 69.

The exemplary embodiment uses elongated triangular loops 61 formed by segments 62A, 62B of embroidered lacing cord 62 to help transfer tension across a larger area of the upper 20. As seen in FIG. 6, each embroidered segment 62A, 62B extends away from the terminal end 64 at an angle. With this arrangement, as the lace 70 pulls on the loop 61, tension is directed from the loop 61 to the embroidery, and then to the upper 20. The divergence of the embroidered segments 62A, 62B spreads the force over a wider area of the upper 20, and helps prevent the upper 20 from stretching, ripping, etc. and helps prevent the loops 61 from pulling away from the upper 20.

Referring to FIGS. 5 and 6, in some embodiments, the knitted upper 20 can include multiple zones or regions having one or more different physical attributes. In the embodiment shown herein, these regions are indicated by phantom line. For example, the upper 20 can include at least a first region 80, a second region 81, and a third region 82. The primary lacing cord 52 can be embroidered to the upper in the first region 80, and not in the second or third regions 81, 82, with the primary loops 51 being disposed in the first region 80, so that tension on the lacing cord 52 is substantially distributed within the first region 80, and not the second or third regions 81, 82.

Some non-limiting examples of different physical attributes for the different regions include breathability or air permeability, rigidity or stiffness, support, elasticity, and/or abrasion-resistance. In some embodiments, the first region 80 can be stiffer or more stretch resistant than the second or third regions 81, 82. In one example, the first region 80 can be more stretch resistant such that first region 80 provides support for the primary lacing cord 52. The second the third regions 81, 82 can be less stiff or can stretch readily to allow upper 20 to comfortably conform to the wearer's foot.

The varying physical attributes of each region can be achieved in various ways, including knit pattern or yarn type. As described above, certain knit patterns can be disposed in certain regions to impart different physical attributes to different regions of the upper 20. In some embodiments, the first region 80 can have a different knit pattern than the second or third regions 81, 82. In one example, the first region 80 can have a denser knit, such as a Jacquard knit with a higher gauge, and the second and third regions 81, 82 can have a looser knit, such as a Jacquard knit with lower gauge. The looser or more open knit pattern in the second and third regions 81, 82 increase breathability of the upper in these regions. The denser knit pattern in the first region 80 provides support for the primary lacing cord 52.

The more elastic and/or breathable second and third regions 81, 82 can be disposed between the tighter knit first region 80 to which the lacing cords 52, 62 are embroidered. Optionally, the first region 80 can surround, or substantially surround, the second and third regions 81, 82. The second and third regions 81, 82 can have any desired shape, and may depend on the configuration of the lace supports. As shown in the illustrated embodiments, the second region 81 can be triangular, and substantially located between two embroidered segments 52A, 52B of the primary lacing cord 52. The third region 82 can be triangular and inverted with respect to the second region 81. The third region 82 can be located between two of the primary loops 51, with one end confronting or adjacent to the seam 29. The third region 82 can be smaller than the second region 81.

A boundary 83 between the regions, indicated by a dashed line in FIGS. 3 and 5, can be located at a distance from either side of the lacing cord 52. The second and third regions 81, 82 can be substantially centered within adjacent portions of the lacing cord 52, such that the boundary 83 is disposed at a uniform distance from the lacing cord 52 on both sides.

Additional regions having one or more different physical attributes can also be provided. For example, as shown in FIG. 5, one or more additional regions 84 are located on the vamp 24, and can have a breathability or air permeability, rigidity or stiffness, support, elasticity, and/or abrasion-resistance that differs from that of at least the first region 80, and optionally from that of the second and/or third regions 81, 82.

In some embodiments, one or more of the loops 51, 61 may be reinforced by additional embroidery stitches using thread. Referring to FIGS. 5 and 6, optionally, the embroidery attachment of the lacing cord 52, 62 to the upper 20 can be reinforced by applying reinforcement stitches 85, 86, respectively, generally transverse to the segments of the lacing cord 52, 62 being reinforced. The thread forming the reinforcement stitches 85, 86 can be the same as or different from the thread 56, 66 forming the embroidery stitches.

The exemplary embodiment uses an elongated segment of reinforcement stitches 85, 86 across two locations on the lacing cord 52, 62 adjacent to the loops 51, 52 to reinforce the embroidered attachment. The reinforcement stitches 85, 86 may secure the lacing cord 52, 62 to one or more layers of the upper 20, and adjacent the exterior surface 21 of the upper 20 to be visible to the wearer.

As seen in FIG. 6, using one of the primary loops 51 as an example, the reinforcement stitches 85 connects to two spaced points of the lacing cord 52, shown herein as being the where the embroidery terminates on the first and second segments 52A, 52B. With this arrangement, as the secondary lacing cord 62 pulls on the loop 51, tension is directed from the loop 51 to the reinforcement stitches 85, and then to the embroidery thread 56, and then to the upper 20. The elongated segment of reinforcement stitches 85 further transfers the tension over a wider area of the lacing cord 52 and the upper 20, and helps prevent the loop 51 from pulling away from the upper 20. The reinforcement stiches 86 for the secondary loops 61 can be configured in the same manner for the same effect. The length of the reinforcement stitches 85, 86 may be any distance suitable for its described purpose, i.e. to reinforce the loops 51, 61. For example, the stitch length may be any suitable length that crosses over two points of the lacing cord 52, 62.

The stitch technique for reinforcing the loops 51, 61 can vary. In some non-limiting examples, the stitch technique used can include lockstitch, chain stitch, double chain stitch, the buttonhole or blanket stitch, the running stitch, the satin stitch, the cross stitch, or any other conventional stitch technique. A combination of known stitch techniques can be used.

The attachment of the secondary lacing cord 62 can be reinforced at the connection points 67, 68 by applying reinforcement stitches 87, 88. Other reinforcement locations are possible. The reinforcement stitches 85-88 can include rows of stands passing over the lacing cord 52, 62, through the upper material to cross to the inner surface of the upper 20 and crossing over the opposite side of the lacing cord 52, 62. The rows of stands can form a straight line. In other embodiments, the reinforcement stitches 85 can form other patterns, such as a curve, chevron, or other geometric shapes or combination of shapes, characters such as letters or numbers, symbols such as a trademark or logo, and the like.

Figure 7:
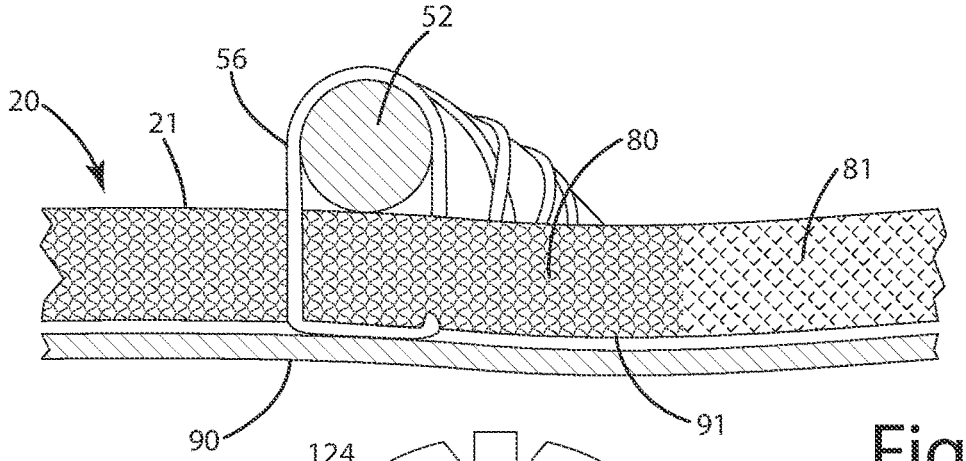
FIG. 7 is a sectional view showing a portion of an embroidered lace support of the lacing system, taken along lines VII-VII of FIG. 6.

In some embodiments, the upper 20 may include more than one layer of materials to define at least an exterior layer and an interior layer. FIG. 7 is a cross-sectional view showing of multiple layer upper 20 formed by an interior liner 90 and an exterior knitted textile layer 91, which defines the exterior 21 of the upper 20. The liner 90 forms an anti-abrasion layer, and can be made of a material that is soft to the skin, such as silk or cotton, as well as synthetic-like equivalents such as nylon, or foam materials. Furthermore, the liner 90 may combine various materials for different purposes for different sections.

The liner 90 can be formed from one or more material elements joined together to line the upper 20. The liner 90 can extend over a portion of, or the entire interior surface of, the knitted textile layer 91. It is noted that while two layers are shown in FIG. 7, the upper 20 can include additional layers (not shown).

In some embodiments, the lacing cords 52, 62 are embroidered to the outer knitted textile layer 91 and not the liner 80. For example, using the primary lacing cord 52 as an example in FIG. 7, the embroidery thread 56 may extend only into the knitted textile layer 91 and is not stitched through the liner 90. In this case, the liner 90 can prevent the wearer's foot from rubbing against the embroidery stitches securing the lacing cord 52 to the knitted textile layer 91. In other embodiments, the thread 56 may extend into the liner 90 to embroider the lacing cord 52 to the upper 20.

In the example shown in FIG. 7, each stitch of thread 56 extends over an outer surface of the lacing cord 52 between two openings in the knitted textile layer 91 to attach the lacing cord 52 to the exterior surface 21 of the upper 20. As another option, the thread 56 can extend through the lacing cord 56, penetrating an outer surface of the lacing cord 52 at one location and emerging at another location on the lacing cord 52.

The knitted textile layer 91 can include the first region 80, second region 81, and third region 82 discussed above with reference to FIG. 6. As shown in FIG. 7, the thread 56 may extend only into the first region 80 and not into the second region 81.

While not shown in FIG. 7, an embroidery backing can be used as a or stabilizer to support the stitches and support the knitted textile layer 91, or other layer of the upper 20 to which the embroidery is applied. The backing can also keep the upper 20 from puckering or moving while it is being embroidered. The backing can be disposed in an inner side of the knitted textile layer 91 or other layer of the upper 20 to which the embroidery is applied, and the thread 56 can be routed through openings in the backing as well as in the knitted textile layer 91 or other layer.

Figure 8:
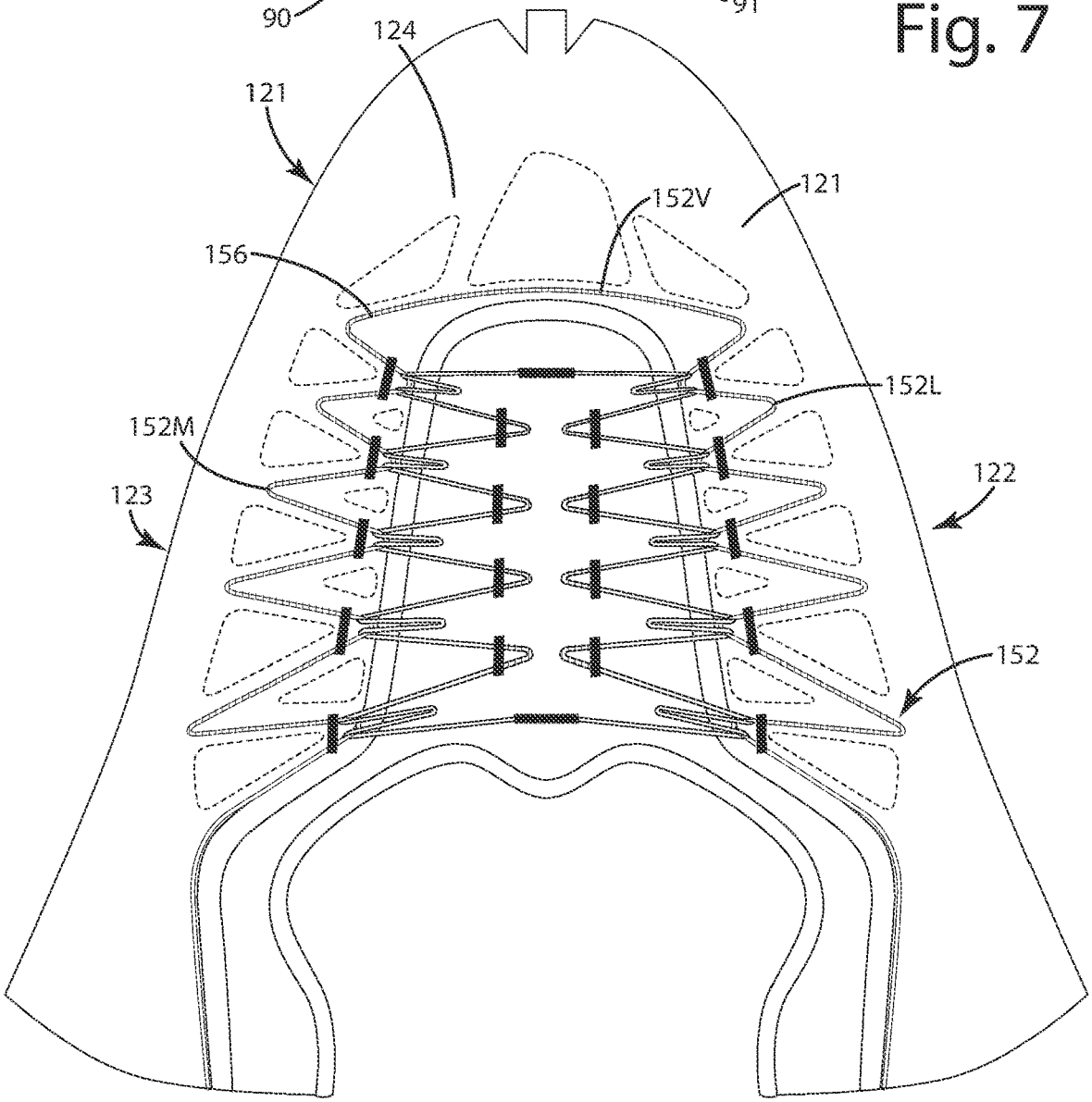
FIG. 8 is a top plan view of an alternative embodiment of a portion of an upper for the footwear of FIG. 1.

An alternative embodiment of a forefoot portion of the upper is shown in FIG. 8 and generally designated 120. This upper 120 can be provided on the footwear 10 described with respect to FIGS. 1-7 and is similar to the embodiment of the upper 20 described above, therefore like parts will be identified with like reference numerals increased by 100, with it being understood that the description of the embodiment of the upper 20 shown in FIGS. 1-7 applies to the second embodiment of the upper 120 shown in FIG. 8, except where noted. For example, instead of extending to first and second ends 52F, 52S (see FIG. 5), the primary lacing cord 152 can extend over the vamp 124 from the lateral side to the medial side of the upper 120. As shown herein, the lacing cord 152 can be provided as a continuous loop around the upper 120, with an elongated vamp segment 152V of the lacing cord 152 extending across the vamp 124 and attached to the exterior surface 121 of the upper 120 with embroidery thread 156. The elongated vamp segment 152V can join the lateral and segments 152L, 152M. While not shown herein, the primary lacing cord 152 can include an include an elongated heel segment extending around the heel panel of the upper 20, generally between the lateral and medial segments 152L, 152M. See, for example, heel segment 52H in FIG. 2.

With any of the embodiments of the footwear 10 disclosed herein, the footwear 10 can include additional fastening provisions, include, but are not limited to, cables, straps, buttons, zippers as well as any other provisions known in the art for fastening footwear. The lacing system 30 can include other components known in the art for fastening footwear, including one or more eyelets, tabs, channels, hooks, D-rings, or the like.

There are several advantages of the present disclosure arising from the various features of the articles, systems, and methods described herein. For example, the embodiments of the invention described herein provide a lacing system that can distribute pulling force from a lace across a wide area of the upper, and helps prevent stretching, ripping, or pulling of the parts of the footwear. By embroidering elongated segments of the lace supports for the lace to a knitted upper, tension can be distributed across multiple points of the knitted upper, which provides a robust construction. Similar advantages are provided for non-knitted uppers, such as uppers made from thin materials.

Another advantage of the present disclosure realized in at least some embodiments of the articles, systems, and methods described herein is that the lace interlocks the secondary lace support with the primary lace support, and can prevent the secondary loops from withdrawing completely from the primary loops.

Yet another advantage of the present disclosure realized in at least some embodiments of the articles, systems, and methods described herein is that portions of the knitted upper can be configured with particular physical attributes for the lacing system. For example, the regions of the upper to which the lacing cords are embroidered can be stiffer and/or denser to provide support for the lacing cords and the regions of the upper between segments of the lacing cords can be more elastic and/or breathable.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

a sole;

an upper joined with the sole and defining a foot void configured to receive a wearer's foot, the upper including an exterior surface having a lateral side and a medial side; and a lacing cord on the exterior surface of the upper, the lacing cord extending back and forth on the upper to define:

at least one V-shaped lower turn oriented toward the sole and fixedly attached to the exterior surface of the upper by embroidery stitching, the embroidery stitching including stiches crossing over and under the lacing cord;

at least one V-shaped upper turn oriented away from the sole, the V-shaped upper turn having an upper end forming a loop that is free from attachment to the upper; and a segment of reinforcement stitches extending transversely over the at least one V-shaped upper turn proximally of the loop;

wherein the V-shaped lower turn includes a first portion disposed on a first point of the upper, a second portion disposed on a second point of the upper, the second point spaced from the first point, and the embroidering stitching extends along the length of the lacing cord between the first and second points.

2. The article of footwear of claim 1, wherein the V-shaped lower turn comprises a first segment and a second segment of the lacing cord, embroidered to the upper in an angular shape that distributes tension forces through the first and second segments to the upper in at least two locations on the upper.

3. The article of footwear of claim 2, wherein the at least one V-shaped lower turn comprises a lower end, wherein the first and second segments diverge in a direction away from the lower end.

4. The article of footwear of claim 1, wherein the segment of reinforcement stitches extending over two spaced points of the lacing cord, to connect the two spaced points of the lacing cord to the upper.

5. The article of footwear of claim 1, wherein the loop has a first end and a second end spaced laterally from the first end, wherein the segment of reinforcement stitches extends across the first and second ends of the loop.

6. The article of footwear of claim 1, wherein the segment of reinforcement stitches secures the lacing cord to at least one layer of the upper and are visible to the wearer.

7. The article of footwear of claim 1, wherein the embroidery stitching terminates at the segment of reinforcement stitches.

8. The article of footwear of claim 1, wherein the upper comprises an exterior layer defining the exterior surface and an interior layer; and wherein stiches pass from the interior layer, beyond the exterior surface, and over the lacing cord.

9. The article of footwear of claim 1, wherein the lacing cord has a first end and a second end;

wherein the first end is secured to a first connection point on a lateral side of the sole and the second end secured to a second connection point on a medial side of the sole; and wherein the lacing cord is continuous between the first and second ends.

10. The article of footwear of claim 9, wherein the lacing cord extends back and forth over the medial side of the upper to define at least one V-shaped lower turn and at least one V-shaped upper turn on the medial side of the upper.

11. The article of footwear of claim 9, wherein the upper includes a vamp forming a forefoot portion of the upper, and the lacing cord extends over the vamp.

12. The article of footwear of claim 1, wherein the lacing cord comprises:

an elongated lateral segment extending over the lateral side of the upper and defining the at least one V-shaped lower turn and the at least one V-shaped upper turn on the lateral side; and an elongated medial segment extending over the medial side of the upper and defining at least one additional V-shaped lower turn and at least one additional V-shaped upper turn on the medial side.

13. The article of footwear of claim 12, wherein the lacing cord defines:

a first plurality of V-shaped lower turns and a first plurality of V-shaped upper turns on the lateral side of the upper, the first plurality of V-shaped upper turns forming a plurality of lateral loops on the lateral side of the upper; and a second plurality of V-shaped lower turns and a second plurality of V-shaped upper turns on the medial side of the upper, the second plurality of V-shaped upper turns forming a plurality of medial loops on the medial side of the upper.

14. The article of footwear of claim 1, wherein the upper comprises a knitted layer defining the exterior surface, an interior surface opposite the exterior surface, and a liner disposed inwardly of the knitted layer and forming at least a portion of the foot void;

wherein the at least one V-shaped lower turn is fixedly attached to the knitted layer by the embroidery stitching; and wherein the liner covers the embroidery stitching on the interior surface.

15. The article of footwear of claim 1, wherein the upper comprises a tongue configured to extend over an instep of a wearer's foot; and wherein the lacing cord is not connected to the tongue, and the loop extends free of the upper toward the tongue.

16. The article of footwear of claim 1, comprising a lace to adjust the fit of the article of footwear around the wearer's foot.

17. The article of footwear of claim 1, wherein the lacing cord is a braided nylon cord.

18. The article of footwear of claim 1, wherein the lacing cord defines a plurality of V-shaped lower turns and a plurality of V-shaped upper turns which form a plurality of loops.

* * * * *